US008769983B2

(12) United States Patent
Okazaki

(10) Patent No.: US 8,769,983 B2
(45) Date of Patent: Jul. 8, 2014

(54) REFRIGERATION CYCLE APPARATUS

(75) Inventor: Takashi Okazaki, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 757 days.

(21) Appl. No.: 12/989,126

(22) PCT Filed: Mar. 13, 2009

(86) PCT No.: PCT/JP2009/054874

§ 371 (c)(1),
(2), (4) Date: Oct. 22, 2010

(87) PCT Pub. No.: WO2009/147882

PCT Pub. Date: Dec. 10, 2009

(65) Prior Publication Data

US 2011/0036118 A1 Feb. 17, 2011

(30) Foreign Application Priority Data

Jun. 5, 2008 (JP) ..... 2008-148004

(51) Int. Cl.

| | |
|---|---|
| ***F25B 1/10*** | (2006.01) |
| ***F25B 1/00*** | (2006.01) |
| ***F25B 9/00*** | (2006.01) |
| ***F25D 9/00*** | (2006.01) |

(52) U.S. Cl.
USPC ..... 62/510; 62/115; 62/199; 62/87; 62/401; 62/402; 62/403

(58) Field of Classification Search
CPC ..... F25B 1/062; F25B 5/02; F25B 2400/75; F25B 9/004; B64D 13/06
USPC ..... 62/199, 87, 510, 401–403
See application file for complete search history.

(56) References Cited

U.S. PATENT DOCUMENTS

| | | | | |
|---|---|---|---|---|
| 6,058,729 | A * | 5/2000 | Lifson et al. | 62/217 |
| 6,360,547 | B1 * | 3/2002 | Reznik | 62/87 |
| 2007/0220915 | A1 * | 9/2007 | Heyl | 62/324.1 |

FOREIGN PATENT DOCUMENTS

| | | | |
|---|---|---|---|
| JP | 11-094379 | A | 4/1999 |
| JP | 2004-108683 | A | 4/2004 |

(Continued)

OTHER PUBLICATIONS

Office Action (Written Notice of Rejection Reason) dated Aug. 16, 2011, issued in the corresponding Japanese Patent Application No. 2010-515795, and an English Translation thereof.

(Continued)

*Primary Examiner* — Mohammad M Ali
*Assistant Examiner* — Erik Mendoza-Wilkenfe
(74) *Attorney, Agent, or Firm* — Buchanan Ingersoll & Rooney PC

(57) ABSTRACT

The present invention provides a refrigeration cycle apparatus using a first compressor and a second compressor driven by an expander and including a high and low pressure heat exchanger, in which a low-pressure-side outlet of the high and low pressure heat exchanger is bypassed to a low pressure portion or an intermediate pressure portion to adjust an inlet density at the expander and thereby provide high efficiency. The high and low pressure heat exchanger of the refrigeration cycle apparatus of the present invention changes an amount of heat exchange between a high-pressure refrigerant and a reduced-pressure refrigerant branched from the high-pressure refrigerant at an inlet portion of the high and low pressure heat exchanger and reduced in pressure to adjust the density of the refrigerant flowing in the expander so that power recovered by the expander and power required by the second compressor match.

8 Claims, 8 Drawing Sheets

(56) References Cited

FOREIGN PATENT DOCUMENTS

| | | | | |
|---|---|---|---|---|
| JP | 3708536 | B1 | | 10/2005 |
| JP | 2006-125790 | A | | 5/2006 |
| JP | 2007-212024 | | * | 8/2007 |
| JP | 2007-212024 | A | | 8/2007 |
| JP | 2007-218460 | A | | 8/2007 |
| JP | 2008-014602 | A | | 1/2008 |
| JP | 2008-020152 | A | | 1/2008 |
| WO | WO2008/054380 | A2 | * | 8/2008 |

OTHER PUBLICATIONS

International Search Report (PCT/ISA/210) issued on Jun. 9, 2009, by Japanese Patent Office as the International Searching Authority for International Application No. PCT/JP2009/054874.

* cited by examiner

REFRIGERATION CYCLE APPARATUS

TECHNICAL FIELD

The present invention relates to a refrigeration cycle apparatus using a supercritical refrigerant, and more particularly, to a structure of a refrigeration cycle apparatus in which power required for driving a second compressor connected in series to a first compressor is covered by power recovered by an expander.

BACKGROUND ART

Conventionally, there is known, as a refrigeration cycle apparatus including an expander, a refrigeration cycle apparatus including a compression mechanism which connects an auxiliary compression mechanism and an expansion mechanism by one shaft and compresses a refrigerant, the auxiliary compression mechanism for further compressing the refrigerant discharged from the compression mechanism, a radiator for cooling the refrigerant discharged from the auxiliary compression mechanism, an evaporator for heating the refrigerant flowing out from the expansion mechanism, a bypass flow passage bypassing the expansion mechanism, a bypass valve installed in the bypass flow passage, and an operating device for controlling the operation of the bypass valve, in which the operating device changes the degree of opening of the bypass valve to adjust a high-pressure side pressure (see, for example, Patent Document 1).

The above-mentioned refrigeration cycle apparatus provides high power recovery effect over a wide operating range even when it is difficult for the used expander to adjust the high-pressure side pressure to an optimal value due to a constraint of a constant density ratio.

Here, the density ratio refers to a ratio of a density (DE) of the refrigerant flowing in the expansion mechanism and a density (DC) of the refrigerant flowing in the auxiliary compression mechanism (DE/DC).

Patent Document 1: JP 3708536 B1

DISCLOSURE OF THE INVENTION

Problem to be solved by the Invention

In the refrigeration cycle apparatus, a balance between the power required for driving the auxiliary compression mechanism and a flow rate of the refrigerant flowing through the expansion mechanism is controlled by providing the bypass flow passage bypassing the expansion mechanism and changing the degree of opening of the bypass valve. Therefore, there has been a problem in that, for example, the power recovery effect of the expansion mechanism is reduced corresponding to the flow rate of the refrigerant flowing through the bypass flow passage due to variations in ambient temperature, and hence a value of coefficient of performance (COP: heating and cooling performance (kW)/power consumption (kW)) is reduced.

Further, the refrigerant flowing through the bypass flow passage also passes through the evaporator. Therefore, there has been another problem in that a pressure loss of the refrigerant at the evaporator is increased.

The present invention has been made in order to solve the problems as described above, and has an object of providing a refrigeration cycle apparatus including a high and low pressure heat exchanger in a refrigerant channel portion through which a high-pressure refrigerant flows in an expander, for changing an amount of heat exchange between the high-pressure refrigerant and a reduced-pressure refrigerant to adjust a density of the refrigerant flowing in the expander so that power recovered by the expander and power required by a second compressor match, to thereby improve the COP and reduce the pressure loss of the refrigerant.

Means for Solving the Problems

According to the present invention, there is provided a refrigeration cycle apparatus, including: a first compressor for increasing a pressure of a low-pressure refrigerant, which is a refrigerant on a low pressure side, to output an intermediate-pressure refrigerant, which is the refrigerant of an intermediate pressure; a second compressor connected in series to the first compressor, for increasing a pressure of the intermediate-pressure refrigerant to output a high-pressure refrigerant, which is the refrigerant on a high pressure side; a first heat-source-side heat exchanger which is connected in series to the second compressor and through which the high-pressure refrigerant flows; a high and low pressure heat exchanger connected in series to the first heat-source-side heat exchanger; an expander connected in series to the high and low pressure heat exchanger, for reducing a pressure of the high-pressure refrigerant to output the low-pressure refrigerant and driving the second compressor by power recovered in the pressure reduction; and a load-side heat exchanger connected in series to the expander, in which the high and low pressure heat exchanger changes an amount of heat exchange between the high-pressure refrigerant and a reduced-pressure refrigerant branched from the high-pressure refrigerant at an inlet portion of the high and low pressure heat exchanger and reduced in pressure to adjust a density of the refrigerant flowing in the expander so that the power recovered by the expander and power required by the second compressor match.

According to the present invention, there may also be provided a refrigeration cycle apparatus, including: a first compressor for increasing a pressure of a low-pressure refrigerant, which is a refrigerant on a low pressure side, to output an intermediate-pressure refrigerant, which is the refrigerant of an intermediate pressure; a second compressor connected in series to the first compressor, for increasing a pressure of the intermediate-pressure refrigerant to output a high-pressure refrigerant on a high pressure side; a first heat-source-side heat exchanger connected in series to the second compressor; a high and low pressure heat exchanger connected in series to the first heat-source-side heat exchanger; an expander connected in series to the high and low pressure heat exchanger, for reducing a pressure of the high-pressure refrigerant to output the low-pressure refrigerant and driving the second compressor by power recovered in the pressure reduction; a load-side heat exchanger connected in series to the expander; a first four-way valve installed in a refrigerant channel portion on a discharge side of the high-pressure refrigerant of the second compressor to operate so that the high-pressure refrigerant from the second compressor flows to the first heat-source-side heat exchanger or the load-side heat exchanger; and a second four-way valve installed in a refrigerant channel portion on an inlet side of the high-pressure refrigerant of the high and low pressure heat exchanger to operate so that the high-pressure refrigerant from the load-side heat exchanger or the high-pressure refrigerant from the first heat-source-side heat exchanger flows to the high and low pressure heat exchanger, in which the high and low pressure heat exchanger changes an amount of heat exchange between the high-pressure refrigerant and a reduced-pressure refrigerant branched from the high-pressure refrigerant at an inlet portion of the high and low pressure heat exchanger and reduced in pressure to adjust a density of the refrigerant flowing in the expander so that the power recovered by the expander and power required by the second compressor match.

Effects of the Invention

According to the refrigeration cycle apparatus of the present invention, the high and low pressure heat exchanger changes the amount of heat exchange between the high-pressure refrigerant and the reduced-pressure refrigerant to adjust the density of the refrigerant flowing in the expander so that the power recovered by the expander and the power required by the second compressor match, to thereby improve the COP and reduce the pressure loss of the refrigerant.

BEST MODE FOR CARRYING OUT THE INVENTION

Hereinafter, embodiments of the present invention are described with reference to the drawings. Throughout the drawings, the same reference symbols are assigned to the same or like members and parts for description.

First Embodiment

Figure 1:
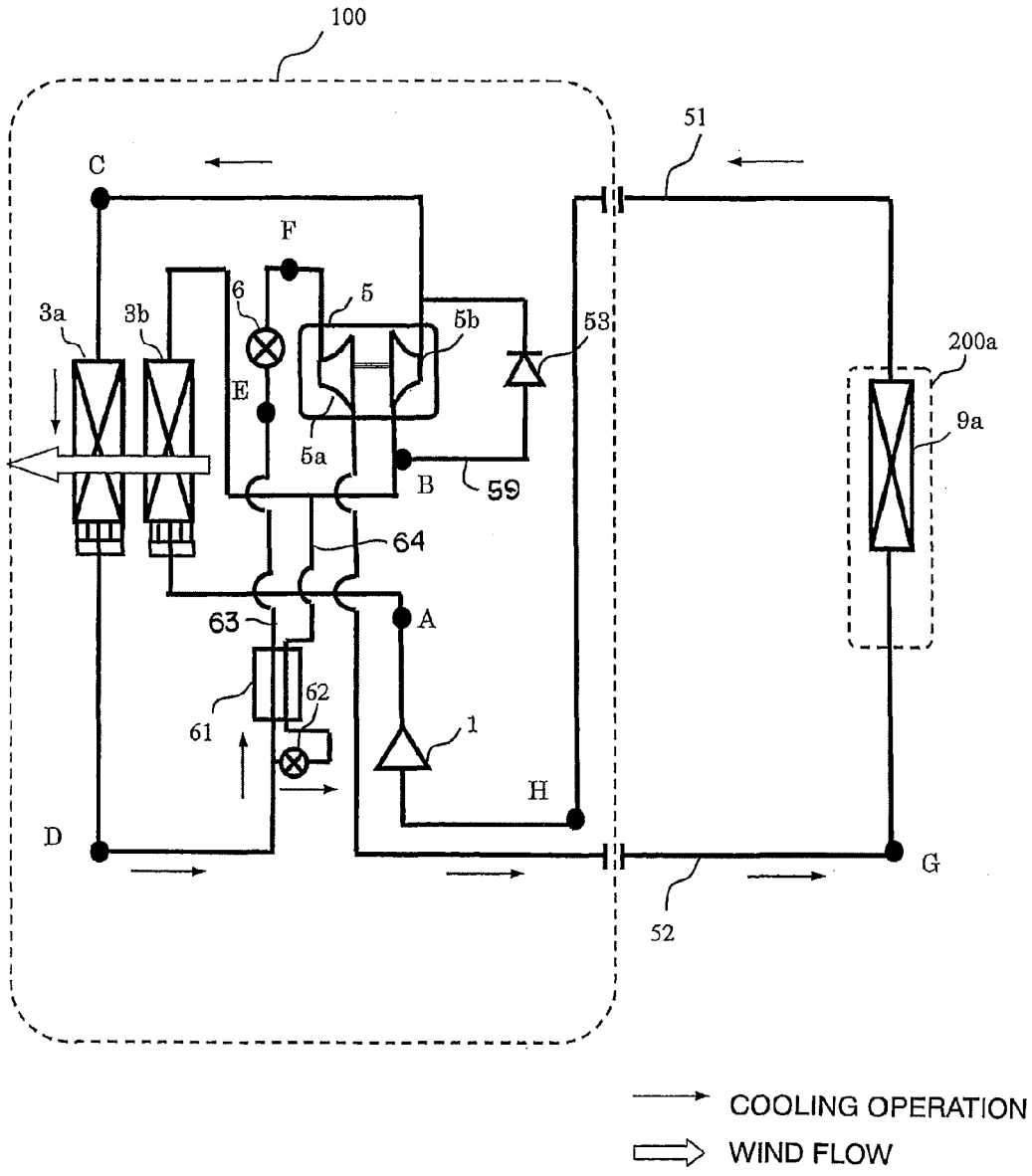
FIG. 1 is a configuration diagram illustrating a refrigeration cycle apparatus according to a first embodiment of the present invention.

FIG. 1 is a configuration diagram illustrating a refrigeration cycle apparatus according to a first embodiment of the present invention.

In the figure, the refrigeration cycle apparatus according to this embodiment includes an outdoor unit 100 and an indoor unit 200*a*.

The outdoor unit 100 includes: a first compressor 1 for increasing the pressure of a low-pressure refrigerant, which is a refrigerant on a low pressure side, to output an intermediate-pressure refrigerant, which is the refrigerant of an intermediate pressure; a second heat-source-side heat exchanger 3*b* connected in series to the first compressor 1 through a refrigerant channel portion; a second compressor 5*b* connected in series to the second heat-source-side heat exchanger 3*b* through the refrigerant channel portion for increasing the pressure of the intermediate-pressure refrigerant to output a high-pressure refrigerant, which is the refrigerant on a high pressure side; and a first heat-source-side heat exchanger 3*a* connected in series to the second compressor 5*b* through the refrigerant channel portion, for allowing the high-pressure refrigerant to flow therethrough.

An intake portion and a discharge portion of the second compressor 5*b* are connected to both ends of a bypass channel portion 59 for bypassing, respectively. A bypass valve 53 is installed in the bypass channel portion 59.

The first heat-source-side heat exchanger 3*a* works as a radiator for radiating heat of the high-pressure refrigerant, and the second heat-source-side heat exchanger 3*b* works as an intermediate cooler for cooling heat of the intermediate-pressure refrigerant. A blower (not shown) included in the outdoor unit 100 blows on external surfaces of the first heat-source-side heat exchanger 3*a* and the second heat-source-side heat exchanger 3*b*.

The outdoor unit 100 also includes: a high and low pressure heat exchanger 61 connected in series to the first heat-source-side heat exchanger 3*a* through the refrigerant channel portion; and an expander 5*a* connected in series to the high and low pressure heat exchanger 61 through a high-pressure-side channel portion 63, for reducing the pressure of the high-pressure refrigerant to output the low-pressure refrigerant and driving the second compressor 5*b* by power recovered in the pressure reduction. A pre-expansion valve 6, which is an on-off valve for providing the same circulating refrigerant flow rate and power for the expander 5*a* and the second compressor 5*b*, is installed in the high-pressure-side channel portion 63.

The expander 5*a* is connected to an indoor heat exchanger 9*a*, which is a load-side heat exchanger of the indoor unit 200*a*, through the refrigerant channel portion and liquid piping 52.

A high-pressure-refrigerant-side intake portion of the high and low pressure heat exchanger 61 is branched to a low-pressure-side channel portion 64. An electronic expansion valve 62 is installed in the low-pressure-side channel portion 64. An end portion of the low-pressure-side channel portion 64 is connected to the refrigerant channel portion between the second heat-source-side heat exchanger 3*b* and the second compressor 5*b*.

Note that, the end portion of the low-pressure-side channel portion 64 may be connected to the refrigerant channel portion between the second heat-source-side heat exchanger 3*b* and the first compressor 1.

The degree of opening of the electronic expansion valve 62 is adjusted to change an amount of heat exchange between the high-pressure refrigerant flowing through the high-pressure-side channel portion 63 and a reduced-pressure refrigerant flowing through the low-pressure-side channel portion 64, adjust a temperature of the high-pressure refrigerant flowing in the expander 5*a* through the high-pressure-side channel portion, and adjust a density of the high-pressure refrigerant, so that the power recovered by the expander 5*a* and the power required by the second compressor 5*b* match.

The indoor unit 200*a* includes the indoor heat exchanger 9*a*, which is the load-side heat exchanger, and a blower (not shown) for forcing indoor air to blow on an external surface of the indoor heat exchanger 9*a*. The indoor heat exchanger 9*a* is connected at one end to gas piping 51 for guiding the low-pressure refrigerant to the first compressor 1 and at the other end to the liquid piping 52 for guiding the low-pressure refrigerant from the expander 5*a* to the indoor heat exchanger 9*a*.

Note that, the refrigerant circulating between the outdoor unit 100 and the indoor unit 200*a* may include, for example, carbon dioxide that reaches a supercritical state at and above a critical temperature (about 31° C.).

Figure 3:
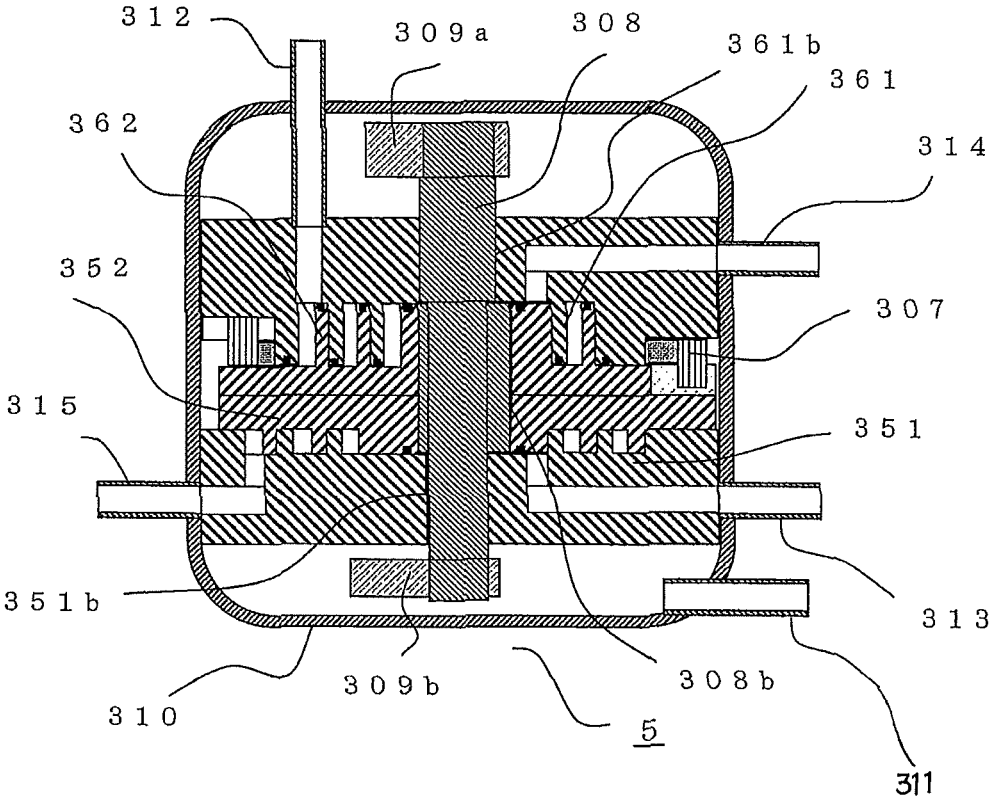
FIG. 3 is a vertical cross-sectional view illustrating an expander unit of FIG. 1.

FIG. 3 is a vertical cross-sectional view illustrating an expander unit 5. The expander unit 5 has an integrated structure of a scroll type in which the expander 5*a* and the second compressor 5*b* are directly connected by a shaft 308.

The expander 5*a* includes an expander fixed scroll 351 and an expander swing scroll 352. The inside of the expander 5*a* is in communication with an expander intake pipe 313 and an expander discharge pipe 315. The second compressor 5*b* includes a second compressor fixed scroll 361 and a second compressor swing scroll 362. The inside of the second compressor 5*b* is in communication with a second compressor intake pipe 312 and a second compressor discharge pipe 314.

The shaft 308 supported by an expander bearing portion 351*b* and a second compressor bearing portion 361*b* passes through the center of the scrolls 351, 352, 361, and 362. Balance weights 309*a* and 309*b* are attached to both ends of the shaft 308, respectively. A back side of the swing scroll 352 of the expander 5*a* and a back side of the swing scroll 362 of the second compressor 5*b* are in surface contact with each other. In addition, necessary parts such as an Oldham ring 307 and a crank portion 308*b* are contained in a sealed container 310. An oil return pipe 311 is connected to the bottom of the sealed container 310 to return oil accumulated at the bottom of the sealed container 310 to the refrigerant channel portion between the indoor heat exchanger 9*a* and the expander 5*a*.

If the expander unit 5 is designed to have a large expansion/compression volume ratio (for example, so that the pre-expansion loss and the bypass loss become smallest at the expansion/compression volume ratio of 2.3 or more), a thrust load from the expander 5*a* to the second compressor 5*b* side is smaller than a thrust load from the second compressor 5*b* to the expander 5*a* side at the same tooth height, with a result that the thrust loads cannot be canceled at both sides, and the expander unit 5 having the structure in which the second compressor 5*b* and the expander 5*a* are integrated is difficult to obtain enough strength.

It is also possible to adopt a scroll with extremely high teeth on the second compressor 5*b* side so as to decrease the thrust load on the second compressor 5*b* side, which leads to a problem of strength.

Therefore, in the case of the expander unit 5 in which each of the expander 5*a* and the second compressor 5*b* has scroll structure, when the expansion/compression volume ratio is set in a range below 2.3, the expander unit 5 may provide high reliability in terms of structure as well as performance.

Figure 2:
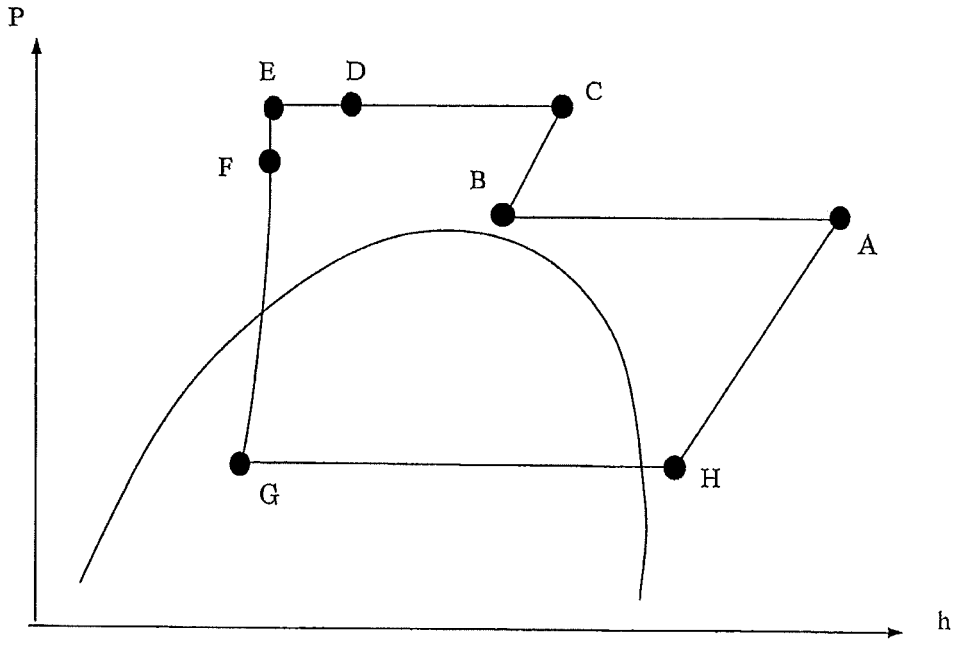
FIG. 2 is a diagram illustrating the cooling operation on a P-h diagram in the refrigerant circuit of FIG. 1.

Next, referring to FIGS. 1 and 2, operation of the refrigeration cycle apparatus structured as above is described.

In FIG. 1, the solid arrows indicate directions in which the refrigerant flows in cooling operation. FIG. 2 illustrates refrigerant states marked by A to H in the refrigerant circuit of FIG. 1 in a P-h diagram. The refrigerant in the states C, D, E, and F is the high-pressure refrigerant on the high pressure side, and the refrigerant in the states G and H is the low-pressure refrigerant on the low pressure side. Further, the refrigerant in the states A and B, which is a state in between the high pressure side and the low pressure side, is the intermediate-pressure refrigerant.

The necessary pressure-reducing function is realized by the expander 5*a*, and the pre-expansion valve 6 is adjusted so that an appropriate degree of superheat (for example, 5° C. to 10° C.) is obtained at the outlet portion of the indoor heat exchanger 9*a*.

When the cooling operation is performed, a gas refrigerant of high temperature and intermediate pressure (state A) discharged from the first compressor 1 is cooled by radiating heat in the second heat-source-side heat exchanger 3*b* (state B), and then flows in the second compressor 5*b*. The gas refrigerant flowing in the second compressor 5*b* driven by the expander 5*a* is compressed corresponding to the power recovered by the expander 5*a* (state C).

At this time, the check valve 53 installed in the bypass channel portion 59 of the second compressor 5*b*, which is opened at the time of start when there is no pressure difference, is closed by the high/low pressure difference between the refrigerant gas inlet side and outlet side of the second compressor 5*b* when the expander 5*a* is operated to drive the second compressor 5*b*. The gas refrigerant discharged from the second compressor 5*b* radiates heat to air as a medium to be heated in the first heat-source-side heat exchanger 3*a* (state D), and then flows in the high and low pressure heat exchanger 61.

In the high and low pressure heat exchanger 61, the high-pressure refrigerant flowing through the high-pressure-side channel portion 63 and the reduced-pressure refrigerant that has been reduced in pressure by the electronic expansion valve 62 installed in the low-pressure-side channel portion 64 and flows through the low-pressure-side channel portion 64 exchange heat, and the cooled high-pressure refrigerant (state E) flowing through the high-pressure-side channel portion 63 flows in the pre-expansion valve 6. The high-pressure refrigerant (state F) at the inlet of the expander 5*a*, which has been adjusted in density by the expansion in the pre-expansion valve 6, is reduced in pressure in the expander 5*a* and then passes through the refrigerant channel portion and the liquid piping 52 (state G). Thereafter, the liquid refrigerant reduces the heat load of the space to be air-conditioned in the indoor heat exchanger 9*a*, and then flows in the gas piping 51. The gas refrigerant goes on to flow in the first compressor 1 (state H) and is discharged from the first compressor 1 as the gas refrigerant of high temperature and intermediate pressure (state A).

Next, a method of controlling the expander 5*a* of the expander unit 5 is described.

In this embodiment, the amount of heat exchange in the high and low pressure heat exchanger 61 provided at the refrigerant inlet side of the expander 5*a* is controlled by the electronic expansion valve 62 installed in the low-pressure-side channel portion 64 so that the power recovered by the expander 5*a* and the power required by the second compressor 5*b* match.

Specifically, in an operation state in which (inlet density of the refrigerant flowing in the expander 5*a*/inlet density of the refrigerant flowing in the second compressor 5*b*) (hereinafter, abbreviated as density ratio) is larger than a preset density ratio (for example, under a low ambient temperature condition in which the inlet density of the refrigerant at the expander 5*a* increases), the amount of heat exchange in the high and low pressure heat exchanger 61 is reduced to increase the temperature of the refrigerant flowing in the expander 5*a* and therefore reduce the inlet density of the refrigerant.

In order to reduce the amount of heat exchange in the high and low pressure heat exchanger 61, the degree of opening of the electronic expansion valve 62 is reduced to reduce the flow rate of the refrigerant flowing through the low-pressure-side channel portion 64 on the low pressure side.

On the other hand, in an operation state in which the density ratio is smaller than the preset density ratio, the amount of heat exchange in the high and low pressure heat exchanger 61 is increased to decrease the inlet temperature of the refrigerant flowing in the expander 5*a* and therefore increase the density of the refrigerant. In order to increase the amount of heat exchange in the high and low pressure heat exchanger 61, the degree of opening of the electronic expansion valve 62 is increased to increase the flow rate of the refrigerant flowing through the low-pressure-side channel portion 64 on the low pressure side.

Figure 4:
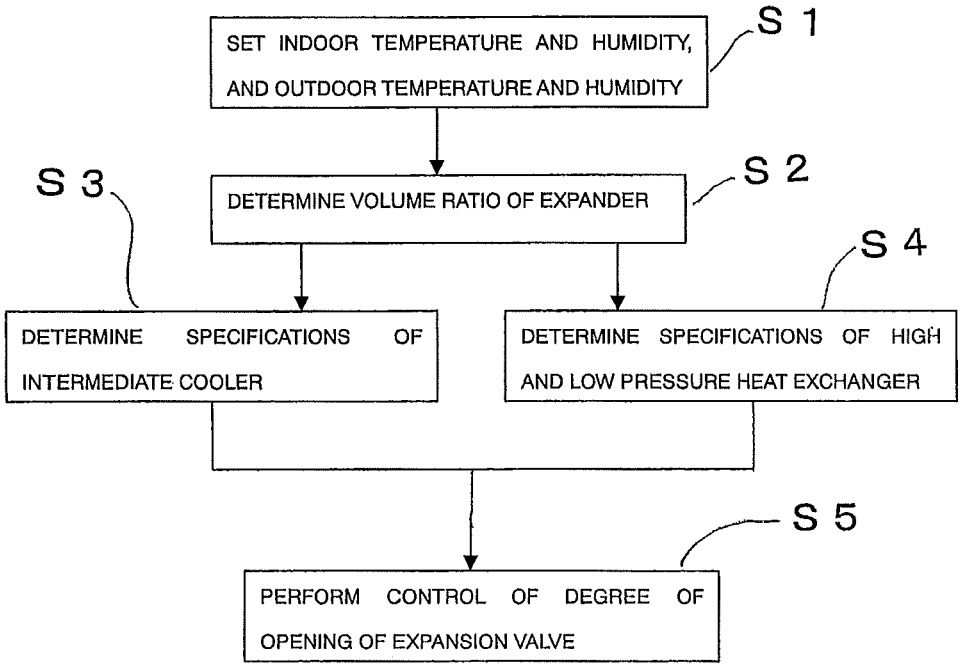
FIG. 4 is a flow chart of designing the refrigeration cycle apparatus of FIG. 1.

FIG. 4 is a flow chart of designing the refrigeration cycle apparatus.

First, changes in environmental condition under which the refrigeration cycle apparatus is to operate are studied, and a range of outdoor temperature and humidity and a range of indoor temperature and humidity are set (Step S1).

Next, the volume ratio of the expander 5*a* is determined (Step S2), specifications of the second heat-source-side heat exchanger 3*b* serving as the intermediate cooler are determined so that operation may be realized with the given environmental condition and the volume ratio of the expander 5*a* (Step S3), and specifications of the high and low pressure heat exchanger 61 are determined (Step S4). The amount of heat exchange in the high and low pressure heat exchanger 61 designed as described above is varied by adjusting the degree of opening of the electronic expansion valve 62 (Step S5), to thereby control the inlet density of the refrigerant at the expander 5*a* to a desired value.

In this case, the inlet density of the refrigerant at the expander 5*a* is determined based on the inlet temperature and the inlet pressure of the refrigerant at the expander 5*a*, and the inlet density of the refrigerant at the second compressor 5*b* is determined based on the inlet temperature and the inlet pressure of the refrigerant at the second compressor 5*b*. The inlet pressure of the refrigerant at the expander 5*a* may be detected by a dedicated pressure sensor or the like, but a value of a high-pressure sensor or the like provided for some other purpose may be used instead with compensation for the pressure loss or the like.

Alternatively, the inlet pressure of the refrigerant at the expander 5*a* may be estimated based on operational states such as the air condition, the refrigerant temperature, and the rpm of the second compressor 5*b*.

Further, the inlet pressure of the refrigerant at the second compressor 5*b* may be detected by installing a pressure sensor in piping from the refrigerant outlet of the first compressor 1 to the refrigerant inlet of the second compressor 5*b*, or estimated based on operational states such as the air condition, the refrigerant temperature, and the rpm of the second compressor 5*b*.

Note that, in this embodiment, there has been described an example in which the expander 5*a* is used in a cooling machine. However, the present invention is not limited thereto, and the expander 5*a* may be used also in a heating machine such as a water heater. In such a case, the refrigerant discharged from the second compressor 5*b* heats water in the first heat-source-side heat exchanger 3*a* serving as the radiator.

As described above, according to the refrigeration cycle apparatus of this embodiment, the high and low pressure heat exchanger 61 allows the inlet density of the refrigerant at the expander 5*a* to be adjusted depending on the air condition, and hence the refrigeration cycle apparatus may attain a high COP and high efficiency.

Further, part of the refrigerant is branched to the low-pressure-side channel portion 64, and the branched refrigerant joins the refrigerant flowing through the indoor heat exchanger 9*a* serving as an evaporator, the first compressor 1, and the second heat-source-side heat exchanger 3*b* toward the second compressor 5*b*. In other words, the flow rate of the refrigerant flowing through the indoor heat exchanger 9*a* and through the liquid piping 52 and the gas piping 51, which are relatively long piping, may be reduced by the amount of the branched refrigerant flowing through the low-pressure-side channel portion 64, to thereby reduce the pressure loss of the refrigeration cycle apparatus due to the refrigerant.

Further, the structure is adopted in which the expander 5*a* and the second compressor 5*b* each being of a scroll type are integrated, and in which the second heat-source-side heat exchanger 3*b* is provided in the refrigerant channel portion between the first compressor 1 and the second compressor 5*b* to reduce the density ratio between the inlet density of the refrigerant at the expander 5*a* and the inlet density of the refrigerant at the second compressor 5*b*. Therefore, the expander unit 5 may be configured to provide high reliability in terms of structure as well as performance.

Further, the second heat-source-side heat exchanger 3*b* for exchanging heat between the refrigerant flowing through the refrigerant channel portion and outdoor air is installed in the refrigerant channel portion between the first compressor 1 and the second compressor 5*b* so that the second heat-source-side heat exchanger 3*b* serves as a cooler for cooling the intermediate-pressure refrigerant. Therefore, in combination with the high and low pressure heat exchanger 61 for cooling the high-pressure refrigerant, the variation width of the inlet density of the refrigerant at the expander 5*a* may be increased, and hence the density ratio of the refrigerant may be changed depending on the air condition over a wide range.

Further, the pre-expansion valve 6 is provided at the refrigerant inlet side of the expander 5*a*, and hence the degree of superheat at the indoor heat exchanger 9*a* serving as the evaporator may be controlled, to thereby utilize the indoor heat exchanger 9*a* efficiently.

Further, carbon dioxide is used as the refrigerant. Therefore, compared to the case where another refrigerant is used, adiabatic heat drop (difference between enthalpy upon isenthalpic expansion and enthalpy upon isentropic expansion) is larger because the high pressure side reaches the supercritical state, and hence there may be obtained the refrigeration cycle apparatus in which the expander 5*a* provides higher effect of improving performance. Further, similar effects may be attained by using R410A or R404A that exhibits properties close to the supercritical state on the high pressure side.

Second Embodiment

Figure 5:
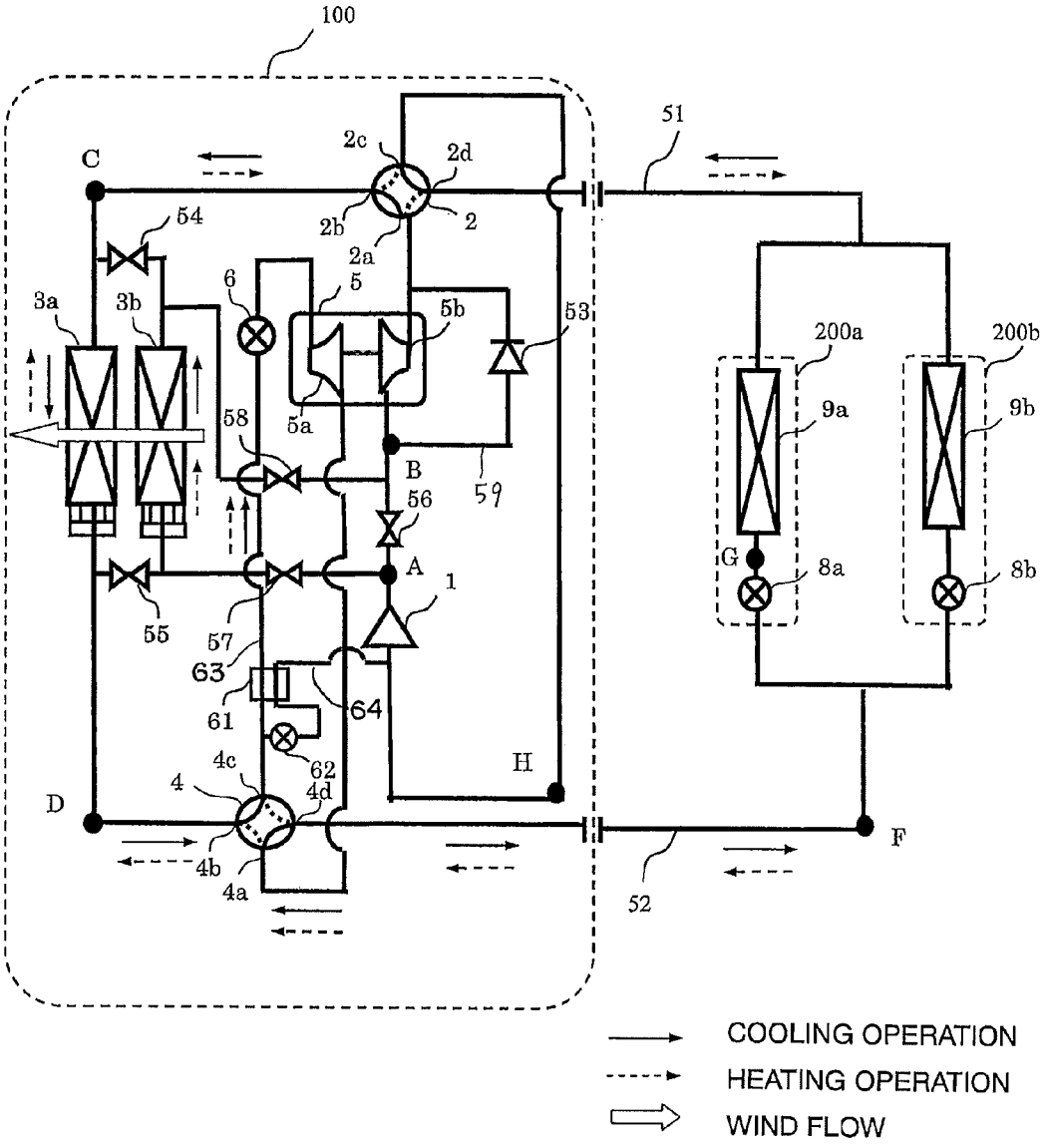
FIG. 5 is a configuration diagram illustrating a refrigeration cycle apparatus according to a second embodiment of the present invention.

FIG. 5 is a configuration diagram illustrating a refrigeration cycle apparatus according to a second embodiment of the present invention.

In this embodiment, the outdoor unit 100 includes a first four-way valve 2 that allows switching between the cooling operation and heating operation of the first compressor 1, and a second four-way valve 4 that allows switching between cooling power recovery operation and heating power recovery operation of the expander 5*a*.

The first four-way valve 2 is installed in the refrigerant channel portion at the high-pressure refrigerant discharge side of the second compressor 5*b*. The second four-way valve 4 is installed in the refrigerant channel portion that guides the high-pressure refrigerant from the first heat-source-side heat exchanger 3*a* to the high and low pressure heat exchanger 61 in the cooling operation.

The outdoor unit 100 is connected to two indoor units 200*a* and 200*b* through the gas piping 51 and the liquid piping 52. Solenoid valves 54, 55, 56, 57, and 58 serving as on-off valves are installed in the refrigerant channel in the outdoor unit 100 so that each of the first heat-source-side heat exchanger 3*a* and the second heat-source-side heat exchanger 3*b* may be used for both the cooling operation and the heating operation.

Other configurations are the same as those of the first embodiment, and the detailed description thereof is omitted.

Next, operation of the refrigeration cycle apparatus is described.

Figure 6:
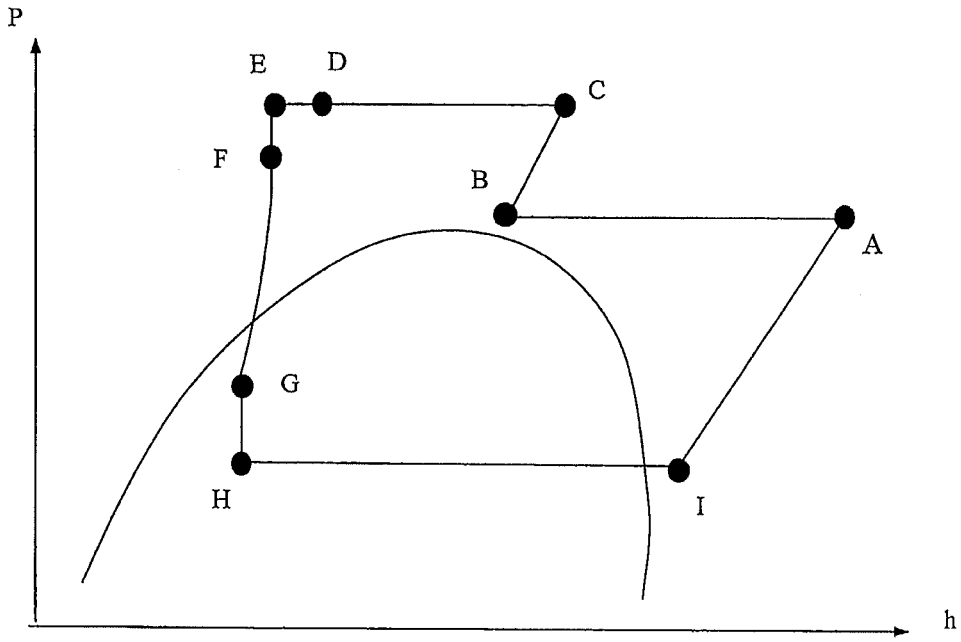
FIG. 6 is a diagram illustrating the cooling operation on a P-h diagram in the refrigerant circuit of FIG. 5.

First, referring to FIGS. 5 and 6, operation in the cooling operation is described.

In the cooling operation, as indicated by the solid lines in FIG. 5, a first port 2*a* and a second port 2*b* are in communication with each other, and a third port 2*c* and a fourth port 2*d* are in communication with each other in the first four-way valve 2. Similarly, a first port 4*a* and a fourth port 4*d* are in communication with each other, and a second port 4*b* and a third port 4*c* are in communication with each other in the second four-way valve 4. At this time, the solenoid valves 54, 55, and 56 are closed, and the solenoid valves 57 and 58 are opened.

The gas refrigerant of high temperature and high pressure (state A) discharged from the first compressor 1 passes through the solenoid valve 57 to flow in the second heat-source-side heat exchanger 3*b*. The refrigerant is cooled by radiating some heat in the second heat-source-side heat exchanger 3*b*, and then flows in the solenoid valve 58. After passed through the solenoid valve 58, the gas refrigerant (state B) flows in the second compressor 5*b* driven by the expander 5*a*, and is compressed corresponding to the power recovered by the expander 5*a*.

Then, the gas refrigerant discharged from the second compressor 5*b* flows from the first port 2*a* to the second port 2*b* of the first four-way valve 2 (state C), radiates heat to air as a medium to be heated in the first heat-source-side heat exchanger 3*a* (state D), and flows from the second port 4*b* to the third port 4*c* of the second four-way valve 4 and in the high and low pressure heat exchanger 61. In the high and low pressure heat exchanger 61, the high-pressure refrigerant flowing through the high-pressure-side channel portion 63 and the reduced-pressure refrigerant that has been reduced in pressure by the electronic expansion valve 62 installed in the low-pressure-side channel portion 64 and flows through the low-pressure-side channel portion 64 exchange heat, and the cooled high-pressure refrigerant (state E) flowing through the high-pressure-side channel portion 63 flows in the pre-expansion valve 6. The high-pressure refrigerant (state F) at the inlet of the expander 5*a*, which has been adjusted in density by the expansion in the pre-expansion valve 6, is reduced in pressure in the expander 5*a* and then passes through the refrigerant channel portion and the liquid piping 52 (state G). Thereafter, the liquid refrigerant, which is the refrigerant (state H) that has been adjusted in refrigerant flow rate to the indoor units 200*a* and 200*b* by electronic expansion valves 8*a* and 8*b* in the indoor units, reduces the indoor heat load in indoor heat exchangers 9*a* and 9*b*, and flows through the gas piping 51 and then from the fourth port 2*d* to the third port 2*c* of the first four-way valve 2 to return to the intake portion of the first compressor 1 (state I). Then, the gas refrigerant flows in the first compressor 1, and is discharged from the first compressor 1 as the intermediate-pressure refrigerant (state A), which is the refrigerant of high temperature and intermediate pressure.

Figure 7:
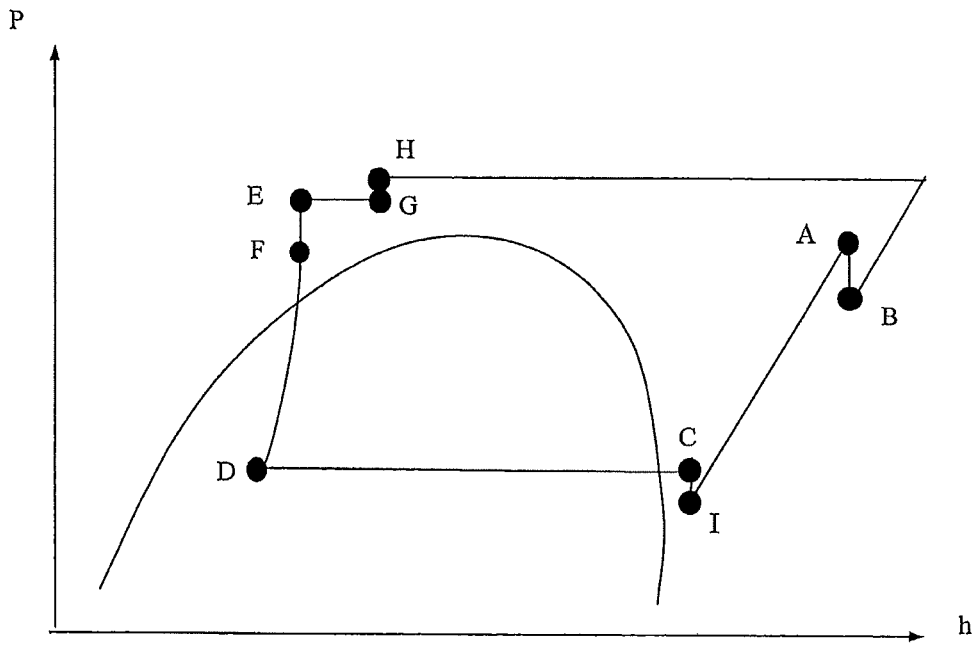
FIG. 7 is a diagram illustrating the heating operation on a P-h diagram in the refrigerant circuit of FIG. 5.

Next, referring to FIGS. 5 and 7, operation in the heating operation is described.

In the heating operation, as indicated by the dotted lines in FIG. 5, the first port 2*a* and the fourth port 2*d* are in communication with each other, and the second port 2*b* and the third port 2*c* are in communication with each other in the first four-way valve 2. Similarly, the third port 4*c* and the fourth port 4*d* are in communication with each other, and the first port 4*a* and the second port 4*b* are in communication with each other in the second four-way valve 4. At this time, the solenoid valves 54, 55, and 56 are opened, and the solenoid valves 57 and 58 are closed.

The gas refrigerant of high temperature and high pressure (state A) discharged from the first compressor 1 passes through the on-off valve 56 (state B) to flow in the second compressor 5*b*. After flowing in the second compressor 5*b* driven by the expander 5*a*, the refrigerant is compressed corresponding to the power recovered by the expander 5*a*. The refrigerant discharged from the second compressor 5*b* flows from the first port 2*a* to the fourth port 2*d* of the first four-way valve 2 and in the indoor heat exchangers 9*a* and 9*b* of the indoor units 200*a* and 200*b*.

Then, the refrigerant radiates heat to air as a medium to be heated in the indoor heat exchangers 9*a* and 9*b* (state H), and is slightly reduced in pressure in the electronic expansion valves 8*a* and 8*b* (state G). After passing through the liquid piping 52, the refrigerant flows from the fourth port 4*d* to the third port 4*c* of the second four-way valve 4 and in the high and low pressure heat exchanger 61. In the high and low pressure heat exchanger 61, the high-pressure refrigerant flowing through the high-pressure-side channel portion 63 and the reduced-pressure refrigerant flowing through the low-pressure-side channel portion 64 exchange heat, and the cooled high-pressure refrigerant (state E) flowing through the high-pressure-side channel portion 63 flows in the pre-expansion valve 6. Thereafter, the refrigerant (state F), which has been reduced in pressure by the pre-expansion valve 6, is further reduced in pressure in the expander 5*a*, flows from the first port 4*a* to the second port 4*b* of the second four-way valve 4 (state D) and then through the first heat-source-side heat exchanger 3*a* and the second heat-source-side heat exchanger 3*b* in parallel, and is evaporated in each of the heat exchangers 3*a* and 3*b* (state C). Then, the refrigerant flows from the second port 2*b* to the third port 2*c* of the first four-way valve 2 to return to the intake portion of the first compressor 1 (state I).

In this embodiment, the low-pressure liquid refrigerant is allowed to flow concurrently through the first heat-source-side heat exchanger 3*a* and the second heat-source-side heat exchanger 3*b* in parallel in the heating operation so that the first heat-source-side heat exchanger 3*a* and the second heat-source-side heat exchanger 3*b* are concurrently used as evaporators. However, when the heating load is small, the solenoid valves 54 and 55 may be closed to allow the low-pressure liquid refrigerant to flow through only the first heat-source-side heat exchanger 3*a* so that the first heat-source-side heat exchanger 3*a* is used as the evaporator.

According to the refrigeration cycle apparatus of this embodiment, in addition to the effects of the refrigeration cycle apparatus of the first embodiment, the first four-way valve 2 and the second four-way valve 4 are provided so that the amount of heat exchange of the high and low pressure heat exchanger 61 installed in the refrigerant channel portion at the refrigerant inlet side of the expander 5*a* is controlled by the electronic expansion valve 62 in both the cooling operation and the heating operation. Therefore, the power recovered by the expander 5*a* and the power required by the second compressor 5*b* may be matched, to thereby obtain the refrigeration cycle apparatus of high COP and high efficiency.

Further, the second heat-source-side heat exchanger 3*b* serves, together with the high and low pressure heat exchanger 61, as the intermediate cooler for cooling the refrigerant in the cooling operation for adjustment of the inlet density of the refrigerant flowing in the expander 5*a*, and as the evaporator in the heating operation. Therefore, the first heat-source-side heat exchanger 3*a* and the second heat-source-side heat exchanger 3*b* may be utilized in both the cooling operation and the heating operation, to thereby realize a highly efficient refrigeration cycle.

Third Embodiment

Figure 8:
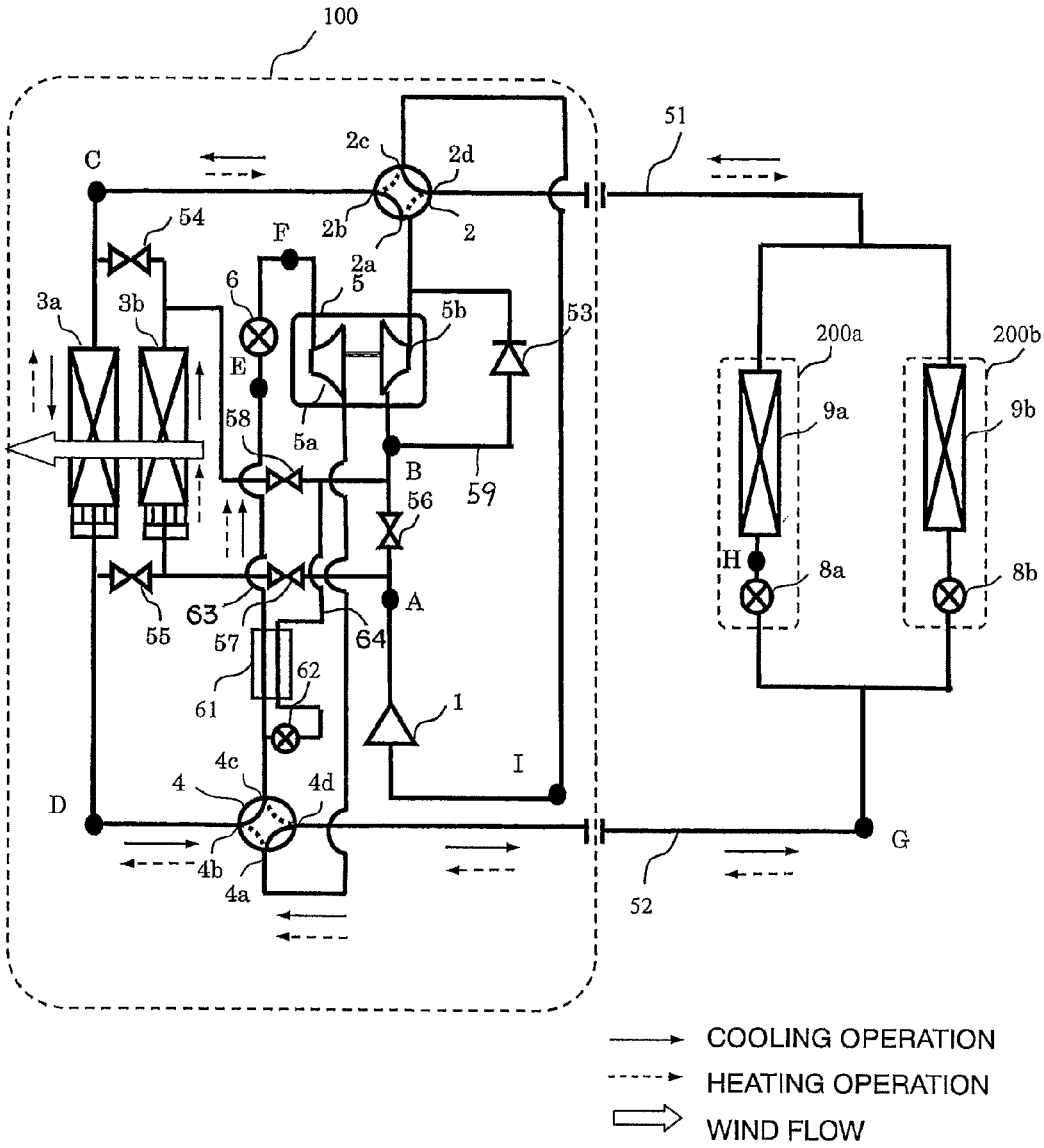
FIG. 8 is a configuration diagram illustrating a refrigeration cycle apparatus according to a third embodiment of the present invention.

FIG. 8 is a configuration diagram illustrating a refrigeration cycle apparatus according to a third embodiment of the present invention.

In this embodiment, the end portion of the low-pressure-side channel portion 64 in which the electronic expansion valve 62 is installed is connected to the intake portion of the first compressor 1 so that the reduced-pressure refrigerant discharged from the high and low pressure heat exchanger 61 is guided to the intake portion of the first compressor 1 to flow in the first compressor 1.

Other configurations are the same as those of the refrigeration cycle apparatus of the second embodiment, and the detailed description thereof is omitted.

In the refrigeration cycle apparatus of this embodiment, the end portion of the low-pressure-side channel portion 64 is connected to the intake portion of the first compressor 1. Therefore, the low-pressure-side channel portion 64 has a pressure equal to the intake pressure of the first compressor 1. Correspondingly, the saturation temperature of the refrigerant flowing in the low-pressure-side channel portion 64 of the high and low pressure heat exchanger 61 is reduced, and the difference between the temperature of the refrigerant flowing through the low-pressure-side channel portion 64 and the temperature of the refrigerant flowing through the high-pressure-side channel portion 63 is increased, to thereby increase the amount of heat exchange in the high and low pressure heat exchanger 61.

Therefore, the variation width of the inlet density of the refrigerant at the expander 5*a* may be increased, and hence the density ratio may be changed depending on the air condition over a wide range.

Note that, in the above-mentioned embodiments, the expander unit 5 having the integrated structure of the scroll type in which the expander 5*a* and the second compressor 5*b* are directly connected by the shaft 308. However, it is clear that the present invention is not limited thereto, and a structure may be employed in which, for example, at least one of the expander and the second compressor is of a rotary type.

The invention claimed is:

1. A refrigeration cycle apparatus, comprising:

a first compressor for increasing a pressure of a low-pressure refrigerant, which is a refrigerant on a low pressure side, to output an intermediate-pressure refrigerant, which is the refrigerant of an intermediate pressure;

a second compressor connected in series to the first compressor, for increasing a pressure of the intermediate-pressure refrigerant to output a high-pressure refrigerant, which is the refrigerant on a high pressure side;

a first heat-source-side heat exchanger which is connected in series to the second compressor and through which the high-pressure refrigerant flows;

a high and low pressure heat exchanger connected in series to the first heat-source-side heat exchanger that exchanges heat between the high-pressure refrigerant and a reduced-pressure refrigerant from a branch of a high-pressure refrigerant line at an inlet portion of the high and low-pressure heat exchanger;

an expander connected in series to the high and low pressure heat exchanger, which reduces a pressure of the high-pressure refrigerant to output the low-pressure refrigerant and drives the second compressor by power recovered in the pressure reduction;

a load-side heat exchanger connected in series to the expander, an expansion valve arranged in the branch of high-pressure refrigerant line before the inlet portion of the high and low pressure heat exchanger that reduces the pressure of the high-pressure refrigerant to the reduced-pressure refrigerant adjusting a density of the refrigerant flowing in the expander so that the power recovered by the expander and power required by the second compressor match; and the expander and the second compressor are directly connected by a shaft.

2. A refrigeration cycle apparatus, comprising:

a first compressor for increasing a pressure of a low-pressure refrigerant, which is a refrigerant on a low pressure side, to output an intermediate-pressure refrigerant, which is the refrigerant of an intermediate pressure;

a second compressor connected in series to the first compressor, which increases a pressure of the intermediate-pressure refrigerant to output a high-pressure refrigerant on a high pressure side;

a first heat-source-side heat exchanger connected in series to the second compressor;

a high and low pressure heat exchanger connected in series to the first heat-source-side heat exchanger;

an expander connected in series to the high and low pressure heat exchanger, for reducing a pressure of the high-pressure refrigerant to output the low-pressure refrigerant and driving the second compressor by power recovered in the pressure reduction;

a load-side heat exchanger connected in series to the expander;

a first four-way valve installed in a refrigerant channel portion on a discharge side of the high-pressure refrigerant of the second compressor operating so that the high-pressure refrigerant from the second compressor flows to the first heat-source-side heat exchanger or the load-side heat exchanger; and a second four-way valve installed in a refrigerant channel portion on an inlet side of the high-pressure refrigerant of the high and low pressure heat exchanger operating so that the high-pressure refrigerant from the load-side heat exchanger or the high-pressure refrigerant from the first heat-source-side heat exchanger flows to the high and low pressure heat exchanger, wherein the high and low pressure heat exchanger changes an amount of heat exchange between the high-pressure refrigerant and a reduced-pressure refrigerant branched from the high-pressure refrigerant at an inlet portion of the high and low pressure heat exchanger and reduced in pressure which adjusts a density of the refrigerant flowing in the expander so that the power recovered by the expander and power required by the second compressor match, and the expander and the second compressor are directly connected by a shaft.

3. A refrigeration cycle apparatus according to claim 1, wherein, after flowing out of the high and low pressure heat exchanger, the reduced-pressure refrigerant is guided to a refrigerant channel portion between the first compressor and the second compressor to flow in the second compressor.

4. A refrigeration cycle apparatus according to claim 1, wherein, after flowing out of the high and low pressure heat exchanger, the reduced-pressure refrigerant is guided to a refrigerant channel portion on an intake side of the first compressor to flow in the first compressor.

5. A refrigeration cycle apparatus according to claim 1, further comprising a second heat-source-side heat exchanger installed in a refrigerant channel portion between the first compressor and the second compressor, for exchanging heat between the refrigerant flowing through the refrigerant channel portion and outdoor air.

6. A refrigeration cycle apparatus according to claim 1, further comprising a pre-expansion valve at an inlet portion of the high-pressure refrigerant of the expander.

7. A refrigeration cycle apparatus according to claim 1, wherein the expander and the second compressor have an integrated structure of a scroll type.

8. A refrigeration cycle apparatus according to claim 1, wherein the refrigerant comprises carbon dioxide.

* * * * *